US005496037A

United States Patent [19]

Rumph

[11] Patent Number: 5,496,037

[45] Date of Patent: Mar. 5, 1996

[54] BATTLEFIELD BOARD GAME

[76] Inventor: Frank J. Rumph, 5700 Bayshore Rd. #806, Palmetto, Fla. 34221-9359

[21] Appl. No.: 383,895

[22] Filed: Feb. 6, 1995

[51] Int. Cl.[6] ..... A63F 3/00

[52] U.S. Cl. ..... 273/255

[58] Field of Search ..... 273/242, 243, 273/255, 262, 260, 261

[56] References Cited

U.S. PATENT DOCUMENTS

| | | | |
|---|---|---|---|
| 899,895 | 9/1908 | Patrick | 273/255 |
| 2,290,669 | 7/1942 | Bowie | 273/255 |
| 3,794,326 | 2/1974 | Bialek | 273/255 X |
| 3,860,241 | 1/1975 | Leftin | 273/255 |
| 3,989,254 | 11/1976 | Cooper . | |
| 4,055,346 | 10/1977 | Garcia-Kuenzli . | |
| 4,261,574 | 4/1981 | Rogers, Jr. | 273/255 X |
| 4,572,514 | 2/1986 | Aponte | 273/255 |
| 4,902,017 | 2/1990 | Grammatico | 273/240 |
| 4,984,806 | 1/1991 | Alfred | 273/255 |
| 5,026,069 | 6/1991 | Legsk | 273/255 |
| 5,251,905 | 10/1993 | Bombino | 273/255 |

FOREIGN PATENT DOCUMENTS

| | | | |
|---|---|---|---|
| 2569124 | 2/1986 | France | 273/255 |
| 1602297 | 11/1981 | United Kingdom | 273/255 |

*Primary Examiner*—William E. Stoll
*Attorney, Agent, or Firm*—Richard L. Miller

[57] ABSTRACT

The invention is a method of playing a war simulation board game having a player one and a player two, and a square game board comprising twelve rows of square boxes forming a grid pattern. A player one set-up zone is formed by the first three rows of square boxes and a player two set-up zone formed by the first three rows of square boxes located at an opposite end thereof. Playing pieces comprise tank playing pieces, soldier playing pieces and anti-tank gun playing pieces. Playing pieces are moved about the game board in accordance with a chance determining device in order to remove an opponent player's playing pieces.

3 Claims, 1 Drawing Sheet

FIG. 1
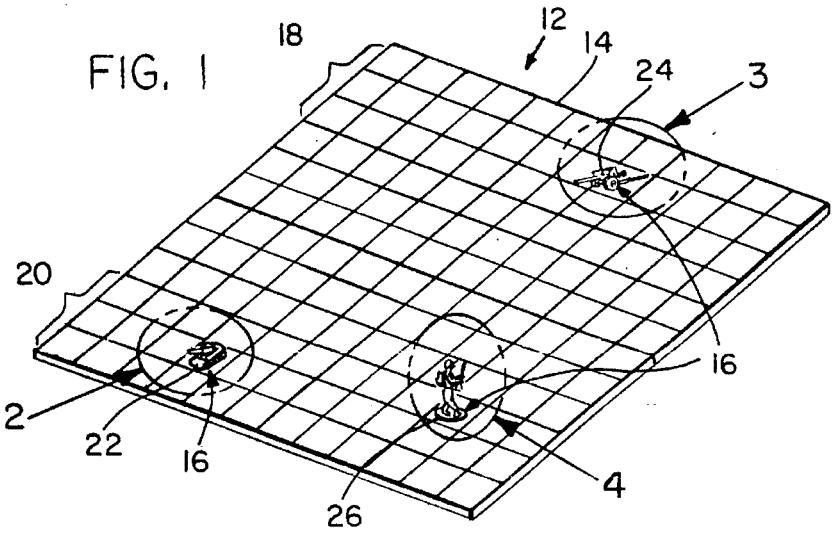
FIG. 5
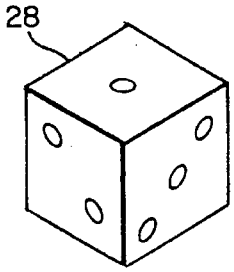
FIG. 2
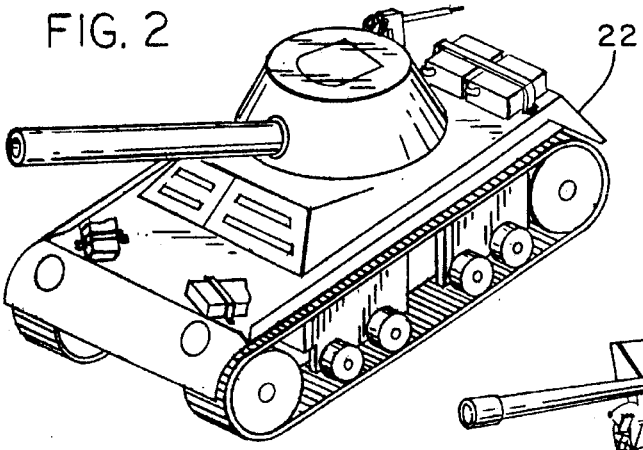
FIG. 3
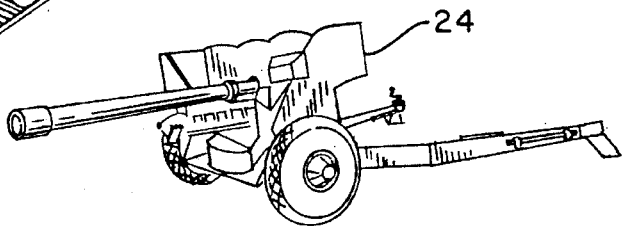
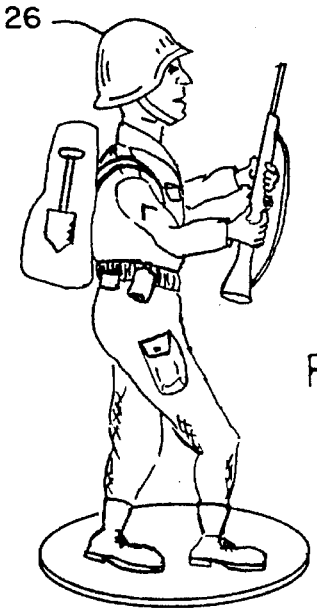
FIG. 4

BATTLEFIELD BOARD GAME

BACKGROUND OF THE INVENTION

The invention relates to a military game, and, more particularly to a new and improved bale strategy game wherein the same utilizes the strategy of deploying soldiers, tanks, and anti-gun tanks and advancing upon opposing positions of enemy forces in order to gain advantages thereover.

Various types of war simulation board games are known in the prior art. A typical example of such a game is to be found in U.S. Pat. No. 5,026,069 to Leask wherein 113 figurative combatants are positioned about a game board through which a simulated river cuts through the center. Combatants are allowed to advance and retreat or attack in response to indication by a six sided dice member.

U.S. Pat. No. 4,902,017 to Grammatico provides for a war simulation board game wherein game pieces simulating war vehicles move about a grid pattern according to a spinning device of chance. Opposing players fire upon each other by standing an ink marker on its tip and depressing on the top end of such marker. The random line formed by the tip of the marker as it slides across the board in response to the external force on its top indicates the projectile shot path. If an opponent's game piece is located in a square through which the projectile shot path travels, a hit is scored.

U.S. Pat. No. 4,055,346 to Garcia-Kuenzli sets forth the playing of a simulation air warfare game. The game includes a game board in the form of a map having irregularly shaped areas delineated by lines and different colors. Various jet aircraft and supporting platforms are also utilized and employed with predetermined rules of play.

U.S. Pat. No. 3,989,254 to Cooper provides for a battle simulating game wherein simulated tanks are releasable secured to a movement control member so that they may all be moved simultaneously in a given direction in accordance with the rules of the game.

While these units may be suitable for the particular purpose employed, or for general use, they would not be as suitable for the purposes of the present invention as disclosed hereafter.

SUMMARY OF THE INVENTION

It is an object of the present invention to produce a war simulation board game including a playing board having a grid pattern formed by a plurality of square segments. The playing board comprises 12 rows of 12 square segments.

Each player possesses a set of 12 soldiers, 12 tanks, and 12 anti-tank guns. Each player's set of playing pieces differs from his or her opponent's playing pieces in color. Each player's playing pieces can be arranged in any order in the first three rows in front of the player. The opponent arranges his or her playing pieces in any order in the first three rows located at the opposite end of the game board.

The game begins by rolling a game die. The number which appears as a result of the die being thrown determines the number of square segments which the player at turn may move his or her playing pieces. Playing pieces may be moved forward, backwards, or sideways, but not diagonally. A player may jump over one of his or her own playing pieces, but may not jump over the playing pieces of an opponent. A jump over a player's own playing piece counts as any other move, and is to be deducted from the players allowable number of square segment moves that were indicated by the die.

A soldier may "take" an opponents soldier or anti-tank gun. An anti-tank gun may "take" an opponents tank or anti-tank gun. Finally, a tank may "take" any of an opponents playing pieces. A player "takes" an opponents playing piece by moving in any direction but not diagonally, or jumping into a square segment which is occupied by an opponent's playing piece.

The invention is a method of playing a war simulation board game having a player one and a player two, and a square game board comprising twelve rows of square boxes forming a grid pattern. A player one set-up zone is formed by the first three rows of square boxes and a player two set-up zone formed by the first three rows of square boxes located at an opposite end thereof. Playing pieces comprise tank playing pieces, soldier playing pieces and anti-tank gun playing pieces. Playing pieces are moved about the game board in accordance with a chance determining device in order to remove an opponent player's playing pieces.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

FIG. 1 is a diagrammatic perspective view of the game board and battlefield components of the instant invention;

FIG. 2 is an enlarged diagrammatic perspective view illustrating a tank playing piece per se indicated in the dotted circle of arrow 2 in FIG. 1;

FIG. 3 is an enlarged diagrammatic perspective view illustrating an anti-tank gun playing piece per se indicated in the dotted circle of arrow 3 in FIG. 1;

FIG. 4 is an enlarged diagrammatic perspective view illustrating a soldier playing piece per se indicated in the dotted circle of arrow 4 in FIG. 1; and FIG. 5 is an enlarged perspective view of a single die utilized as a chance determining element for the invention.

DETAILED DESCRIPTION OF THE PREFERRED EMBODIMENTS

FIG. 1 illustrates a square game board 12 comprising twelve rows of square boxes 14 forming a grid pattern. Each square box 14 is identical in dimension, and a total of one hundred forty-four square boxes are present on the game board 12. Playing pieces 16 are shown placed about the game board 12. A player one set-up zone 18 is formed by the first three rows of square boxes 14, and a player two set-up zone 20 is formed by the first three rows of square boxes 14 located at the opposite end from the player one set-up zone.

FIG. 2 illustrates a tank playing piece 22. An anti-tank gun playing piece 24 is illustrated in FIG. 3. A soldier playing piece 26 is indicated in FIG. 4.

FIG. 5 illustrates a game playing die 28 which functions as a chance determine device. The game playing die 28 is cubical in shape, thus having six sides. Said sides may be numbered in any fashion desired.

The playing method of the game is now briefly described. The game begins by a player one randomly arranging his or her playing pieces 16 in the player one set-up zone 18 and a player two randomly arranging his or her playing pieces 16 in the player two set-up zone 20. The game playing die 28 is then rolled. The number which appears as a result of the game playing die 28 being rolled determines the total number of square boxes 14 which the player at turn may traverse his or her playing pieces 16 over. A player may split the number indicated by the game playing die 28 amongst several of his or her playing pieces 16. Playing pieces 16 may be moved forward, backwards, or sideways, but not diagonally. A player may jump over one of his or her own playing pieces 16, but may not jump over the playing pieces 16 of an opponent. A jump over a player's own playing piece 16 counts as any other move, and is to be deducted from the players allowable number of square box 14 moves that were indicated by the game playing die 28.

The soldier playing piece 26 may "take" and remove an opponents soldier playing piece 26 or anti-tank gun playing piece 24. The anti-tank gun playing piece 24 may remove an opponents tank playing piece 22 or anti-tank gun playing piece 24. Finally, the tank playing piece 22 may remove any of the opponents playing pieces 16. A player "takes" an opponents playing piece 16 by moving in any direction but not diagonally, or jumping into a square 14 which is occupied by an opponent's playing piece 16. The object of the game is to remove all of the opponents playing pieces 16 until none are left on the game board 12.

What is claimed is:

1. A method of playing a war simulation board game having a player one and a player two, a square game board comprising twelve rows of square boxes forming a grid pattern, a player one set-up zone formed by the first three rows of square boxes and a player two set-up zone formed by the first three rows of square boxes located at an opposite end from the player one set-up zone, playing pieces comprising tank playing piece, soldier playing pieces and anti-tank gun playing pieces, comprising the steps of:

a ) arranging by a player one, tank playing pieces, soldier playing pieces and anti-tank gun playing pieces in the player one set-up zone;

b ) arranging by a player two, tank playing pieces, soldier playing pieces and anti-tank gun playing pieces in the player two set-up zone;

c) moving the playing pieces about the game board in order to remove an opponent player's playing pieces, wherein the steps of moving playing pieces about the game board comprises;

i) moving said playing pieces in a direction selected from the group consisting of forwards, backwards, sideways, but not diagonally;

ii ) jumping over a player's own playing piece, but not jumping over the playing pieces of an opponent; and iii) moving any of the game pieces any number of square boxes, so that the total number of square boxes traversed upon by playing pieces is equivalent to the number indicated by a chance determining device, wherein upon a conflict between playing pieces:

I) a tank playing piece can cause an opponent tank playing piece, soldier playing piece and anti-tank gun playing piece to be removed from play;

II) an anti-tank gun playing piece causes an opponent anti-tank gun playing piece and tank playing piece to be removed from play; and III) a soldier playing piece causes an opponent soldier playing piece and anti-tank gun playing piece to be removed from play.

2. The method as recited in claim 1, wherein each player has an equal number of tank playing pieces, soldier playing pieces, and anti-tank gun playing pieces.

3. The method as recited in claim 1, wherein each player has twelve soldier playing pieces, twelve tank playing pieces, and twelve anti-tank playing pieces.

* * * * *